US010501983B2

(12) United States Patent
Bartholdi

(10) Patent No.: US 10,501,983 B2
(45) Date of Patent: Dec. 10, 2019

(54) ELECTROMAGNETIC DOOR OPENER

(71) Applicant: ELDOMAT Innovative Sicherheit GmbH, Berlin (DE)

(72) Inventor: Eberhard Bartholdi, Berlin (DE)

(73) Assignee: ELDOMAT INNOVATIVE SICHERHEIT GMBH, Berlin (DE)

( * ) Notice: Subject to any disclaimer, the term of this patent is extended or adjusted under 35 U.S.C. 154(b) by 885 days.

(21) Appl. No.: 14/767,910

(22) PCT Filed: Feb. 12, 2014

(86) PCT No.: PCT/DE2014/000056

§ 371 (c)(1),
(2) Date: Aug. 13, 2015

(87) PCT Pub. No.: WO2014/124627

PCT Pub. Date: Aug. 21, 2014

(65) Prior Publication Data

US 2015/0368958 A1 Dec. 24, 2015

(30) Foreign Application Priority Data

Feb. 14, 2013 (DE) ..... 20 2013 001 433 U

(51) Int. Cl.
*E06B 5/11* (2006.01)
*E05B 47/00* (2006.01)
(Continued)

(52) U.S. Cl.
CPC ..... *E06B 5/113* (2013.01); *E05B 15/102* (2013.01); *E05B 47/0047* (2013.01);
(Continued)

(58) Field of Classification Search
CPC ..... E05C 17/56; E05C 19/16; E05C 19/161; E05C 19/163; E05C 19/165; E05C 19/166; E05C 19/168; E05C 9/1875; E05C 9/1883; E05C 9/1891; E05B 15/0073; E05B 47/00; E05B 15/0205; E05B 47/0046;
(Continued)

(56) References Cited

U.S. PATENT DOCUMENTS 420,834 A * 2/1890 Seib ..... E05B 47/0047 292/341.16
3,122,388 A * 2/1964 Powers ..... E05B 47/0047 292/201
(Continued)

FOREIGN PATENT DOCUMENTS

DE 102004056567 11/2004

*Primary Examiner* — Kristina R Fulton
*Assistant Examiner* — Faria F Ahmad
(74) *Attorney, Agent, or Firm* — David Guerra

(57) ABSTRACT

The invention relates to an electromagnetic door opener comprising a housing for installing in a door frame, a pivotable cover which can be rotated between an open position and a closed position, and a security device operating counter to a forced rotation of the cover from the closed position into the open position, which comprises a primary security step and a secondary security step. Said door opener is characterized in that the secondary security step comprises a locking element which is supported in a form fit on the base of the housing of the door opener housing.

19 Claims, 3 Drawing Sheets

(51) Int. Cl.

| | |
|---|---|
| ***E05B 15/10*** | (2006.01) |
| ***E05F 15/603*** | (2015.01) |
| ***E06B 7/28*** | (2006.01) |
| ***E05C 19/16*** | (2006.01) |
| ***E05C 9/18*** | (2006.01) |
| ***E05B 63/24*** | (2006.01) |
| ***E05B 15/02*** | (2006.01) |

(52) U.S. Cl.
CPC ..... *E05F 15/603* (2015.01); *E06B 7/28* (2013.01); *E05B 15/0205* (2013.01); *E05B 15/0245* (2013.01); *E05B 47/0046* (2013.01); *E05B 63/246* (2013.01); *E05C 9/1875* (2013.01); *E05C 9/1883* (2013.01); *E05C 9/1891* (2013.01); *E05C 19/165* (2013.01); *E05C 19/166* (2013.01); *E05C 19/168* (2013.01); *Y10T 292/62* (2015.04); *Y10T 292/68* (2015.04); *Y10T 292/694* (2015.04); *Y10T 292/696* (2015.04); *Y10T 292/699* (2015.04); *Y10T 292/702* (2015.04); *Y10T 292/705* (2015.04)

(58) Field of Classification Search
CPC .. E05B 47/0047; E05B 63/246; Y10T 292/68; Y10T 292/694; Y10T 292/696; Y10T 292/699; Y10T 292/702; Y10T 292/705
USPC .... 292/340, 341.14, 341.15, 341.16, 341.17, 292/341.18, 251.5
See application file for complete search history.

(56) References Cited

U.S. PATENT DOCUMENTS 3,543,547 A * 12/1970 Sugiyama ..... E05B 47/0047 292/201
3,640,560 A * 2/1972 Zawadzki ..... E05B 47/0047 292/201
3,861,727 A * 1/1975 Froerup ..... E05B 47/0047 292/341.16
4,595,220 A * 6/1986 Hanchett, Jr. ..... E05B 47/0047 292/341.16
4,626,010 A * 12/1986 Hanchett, Jr. ..... E05B 47/0046 292/341.16
4,756,566 A * 7/1988 Logas ..... E05B 47/0047 292/341.16
4,838,591 A * 6/1989 Fuss ..... E05B 47/0047 292/341.16
4,867,496 A * 9/1989 Thomas ..... E05B 47/0047 292/252
4,917,425 A * 4/1990 Logas ..... E05B 47/0047 292/201
4,986,584 A * 1/1991 Logas ..... E05B 47/0047 292/201
5,042,857 A * 8/1991 Burrows ..... E05B 47/0046 292/201
5,118,150 A * 6/1992 Jarrett ..... E05B 47/0047 292/341.16
5,195,792 A * 3/1993 Stendal ..... E05B 47/0047 292/341.16
5,219,196 A * 6/1993 Luker ..... E05B 47/0047 292/207
5,490,699 A * 2/1996 Uyeda ..... E05B 47/0047 292/201
5,681,070 A * 10/1997 Williams ..... E05B 15/04 292/153
5,690,373 A * 11/1997 Luker ..... E05B 47/0607 292/144
5,735,559 A * 4/1998 Frolov ..... E05B 47/0047 292/210
5,924,750 A * 7/1999 Fuss ..... E05B 47/0047 292/201
5,934,720 A * 8/1999 Karalius ..... E05B 47/0047 292/201
5,988,711 A * 11/1999 Toma ..... E05B 47/0047 292/201
5,990,579 A * 11/1999 Ricci ..... E05B 47/0047 292/341.16
6,082,791 A * 7/2000 Frolov ..... E05B 47/0047 292/201
6,595,563 B2 * 7/2003 Kiernan ..... E05B 47/0047 292/201
6,874,830 B2 * 4/2005 Bashford ..... E05B 47/0047 292/201
6,913,299 B1 * 7/2005 Stendal ..... E05B 47/0047 292/340
6,966,585 B2 * 11/2005 Egi ..... E05B 47/0047 292/144
7,021,684 B2 * 4/2006 Orbeta ..... E05B 47/0046 292/201
7,032,863 B1 * 4/2006 Piorkowski ..... B64C 1/1469 244/129.4
7,562,918 B2 * 7/2009 Toma ..... E05B 47/0047 292/340
7,722,097 B2 * 5/2010 Schnarr ..... E05B 15/0205 292/201
8,096,594 B2 * 1/2012 Uyeda ..... E05B 47/0046 292/340
8,146,966 B1 * 4/2012 Webb ..... E05B 47/0047 292/341.15
8,333,411 B2 12/2012 Blanch
8,783,744 B2 * 7/2014 Scheffler ..... E05B 47/0046 292/341.15
8,851,532 B2 * 10/2014 Geringer ..... E05B 47/0047 292/200
9,255,425 B2 * 2/2016 Wittke ..... E05B 17/0029
9,458,647 B2 * 10/2016 Gartner ..... E05B 17/2092
9,657,501 B2 * 5/2017 Armari ..... E05B 47/0047
2002/0145292 A1 * 10/2002 Furner ..... E05B 47/0603 292/341.16
2005/0140151 A1 6/2005 Egi et al.
2011/0031768 A1 * 2/2011 Scheffler ..... E05B 47/0046 292/341.16
2013/0088023 A1 * 4/2013 Singh ..... E05B 47/0047 292/341.16
2013/0328332 A1 * 12/2013 Scheffler ..... E05B 47/0047 292/341.16
2014/0265378 A1 * 9/2014 Lee ..... D06F 39/14 292/341.17
2015/0284976 A1 * 10/2015 Singh ..... E05B 47/0047 292/341.17

* cited by examiner 11
7
5
1
9
101
100
15
3
13 fig. 4
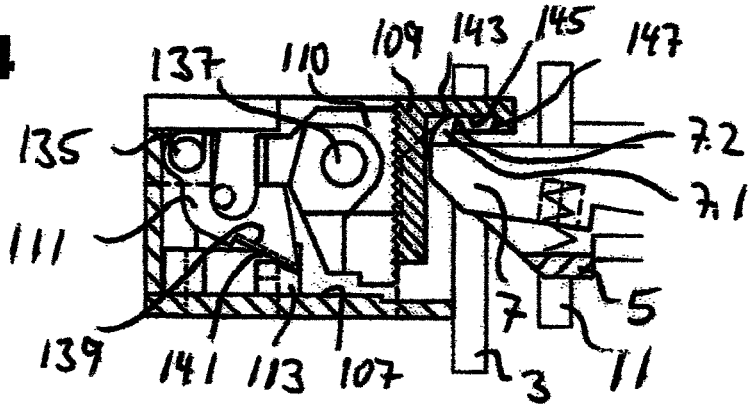
fig. 2
fig. 3
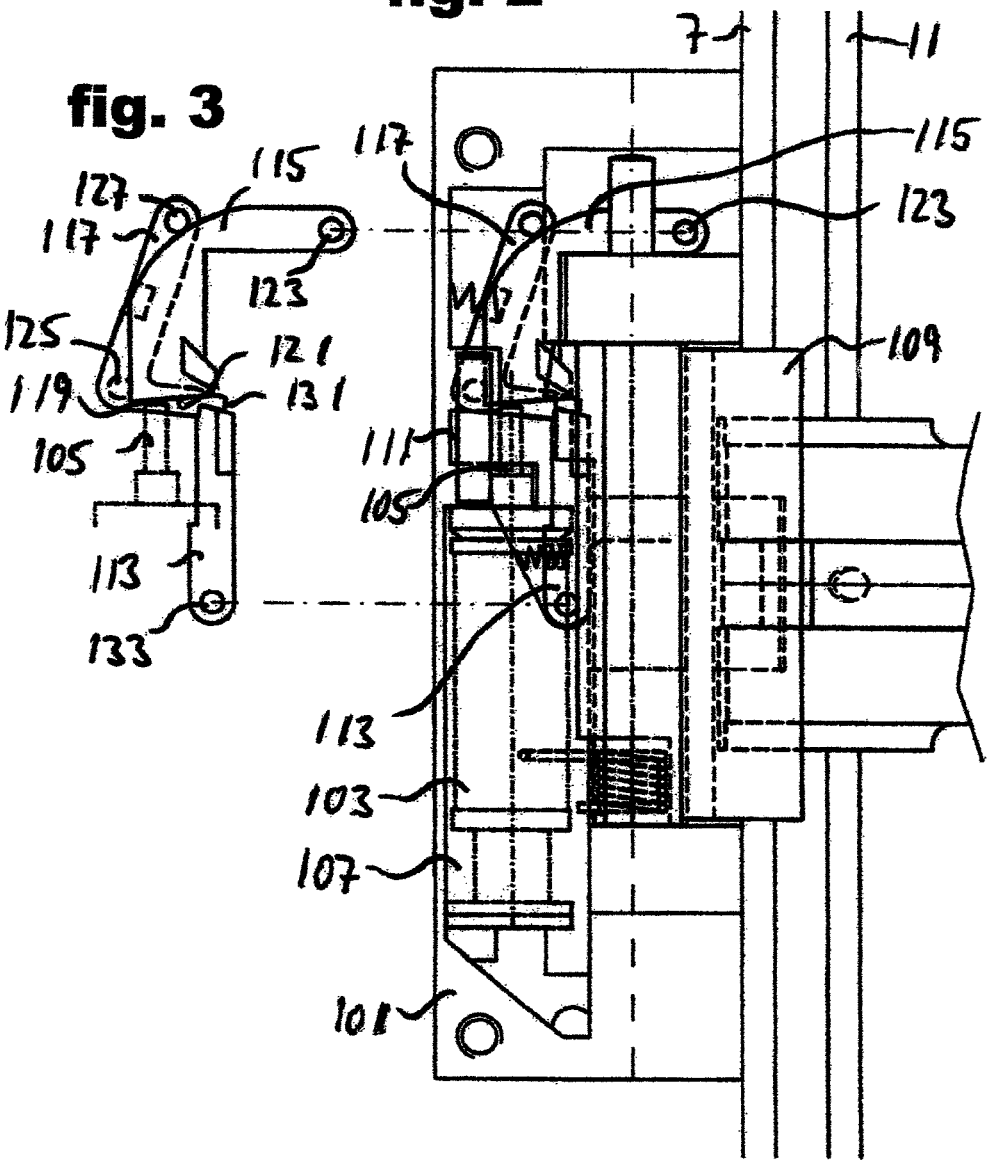

fig. 7
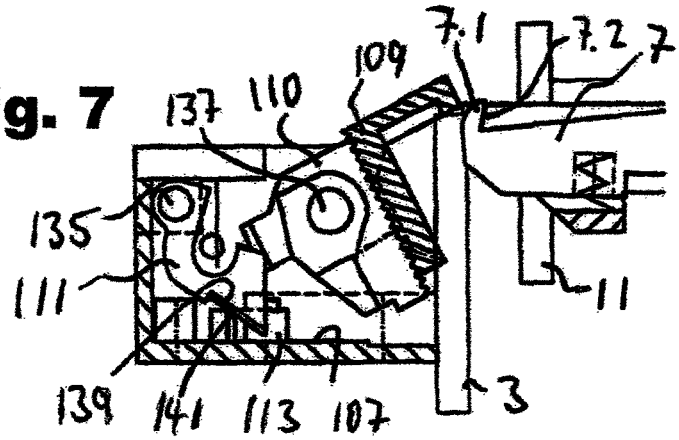
fig. 5
fig. 6
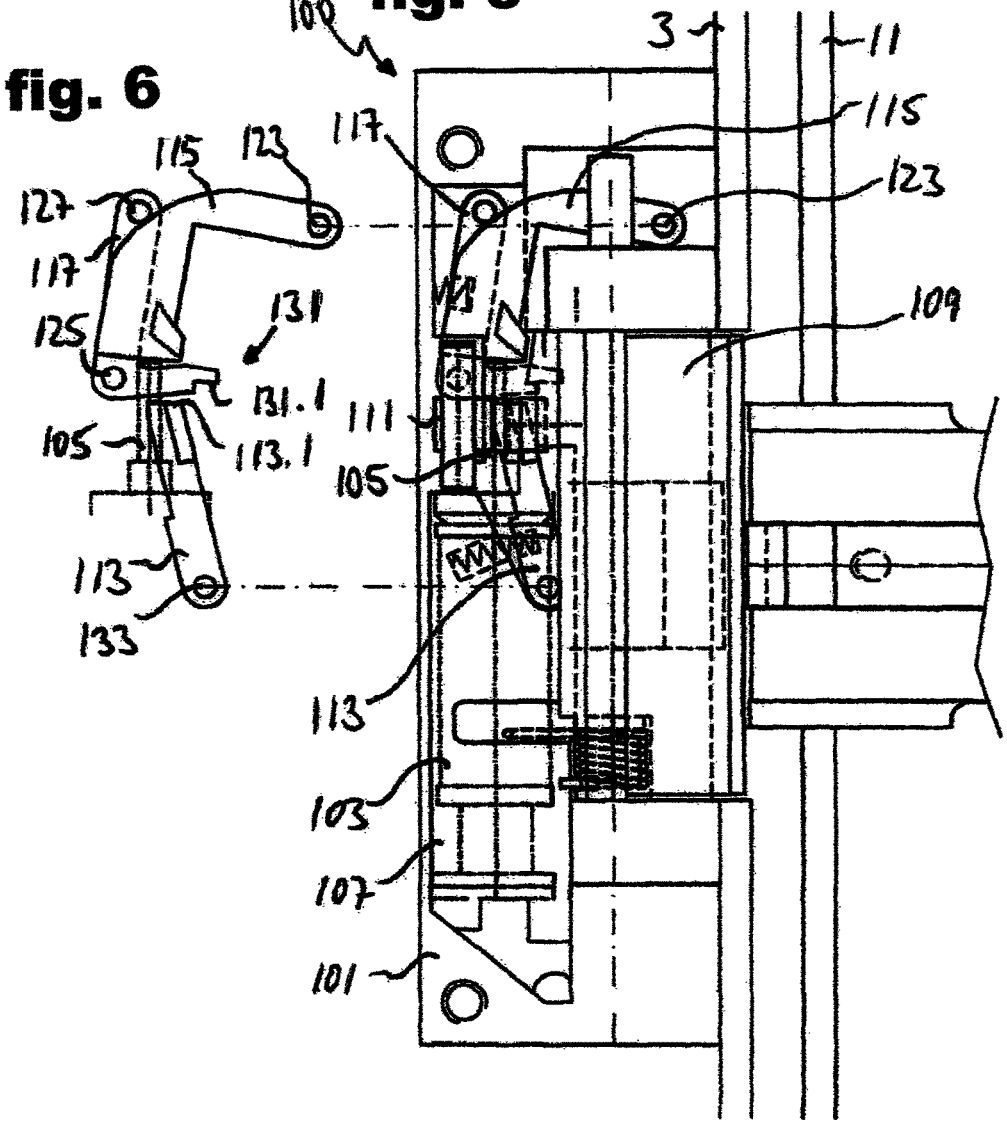

ELECTROMAGNETIC DOOR OPENER

CROSS REFERENCE TO RELATED APPLICATIONS

This application is a Patent Cooperation Treaty National Stage of International Application No. PCT/DE2014/000056, filed Feb. 12, 2014, which takes priority from German Patent Application No. DE 20 2013 001 433.4, filed Feb. 14, 2013. The contents of both of Applications PCT/DE2014/000056 and 20 2013 001 433.4 are incorporated herein by reference.

BACKGROUND

Existing electromagnetic door openers are, for example, known from German Document DE 10 2004 056 567 A1. The remotely operable electric door opener described also comprises locking members, which during a first stage are form-locked with each other. In a second stage however, the resistance to open the door by force is produced by a rather weak formlock between the locking members, i.e. by a leaf spring hook which is in engagement with the door opener strike bolt. The second stage is thus not very effective as a safeguard against twisting.

SUMMARY

The present invention relates to an electromagnetic door opener with a housing for fitting into a doorframe, with a hinged flap rotatable between an open position and a closed position, and having a safety device to resist forcibly twisting the flap from the closed position into the open position, the safety device having a primary safety stage and a secondary safety stage.

It is therefore an objective of the invention to develop an electromagnetic door opener in such a way that the resistance against forcibly opening the door is equally strong both in the first stage and in the second stage.

This requirement is met in that the locking members, in a closed position, form a formlock and are supported against the floor of the housing.

With the aid of the electromagnetic door opener the resistance against opening the door by force is achieved by the formlock both in the first stage and in the second stage, and also by supporting the form-locked locking members against the floor of the housing.

An advantage of the invention is that it allows the door opener to be held in the closed position against a force of 10,000 Newtons acting upon the door opener strike bolt.

A further advantage of the present invention is that the locking members of the first stage comprise a first lever and a second lever and the housing floor and in that the formlock is produced by an oblique surface between the two.

BRIEF DESCRIPTION OF THE DRAWINGS

The present invention will now be described in detail with reference to the drawings, in which:

FIG. 2 shows a schematic side view of the electromagnetic door opener in a closed position;

FIG. 3 shows a schematically drawn detail from FIG. 2;

FIG. 4 shows a schematic view in cross-section of the electromagnetic door opener according to FIG. 2;

FIG. 5 shows a schematic side view of the electromagnetic door opener of FIG. 2 in an open position;

FIG. 6 shows a schematically drawn detail from FIG. 5; and

FIG. 7 shows a schematic view in cross-section of the electromagnetic door opener according to FIG. 5.

DETAILED DESCRIPTION

Figure 1:
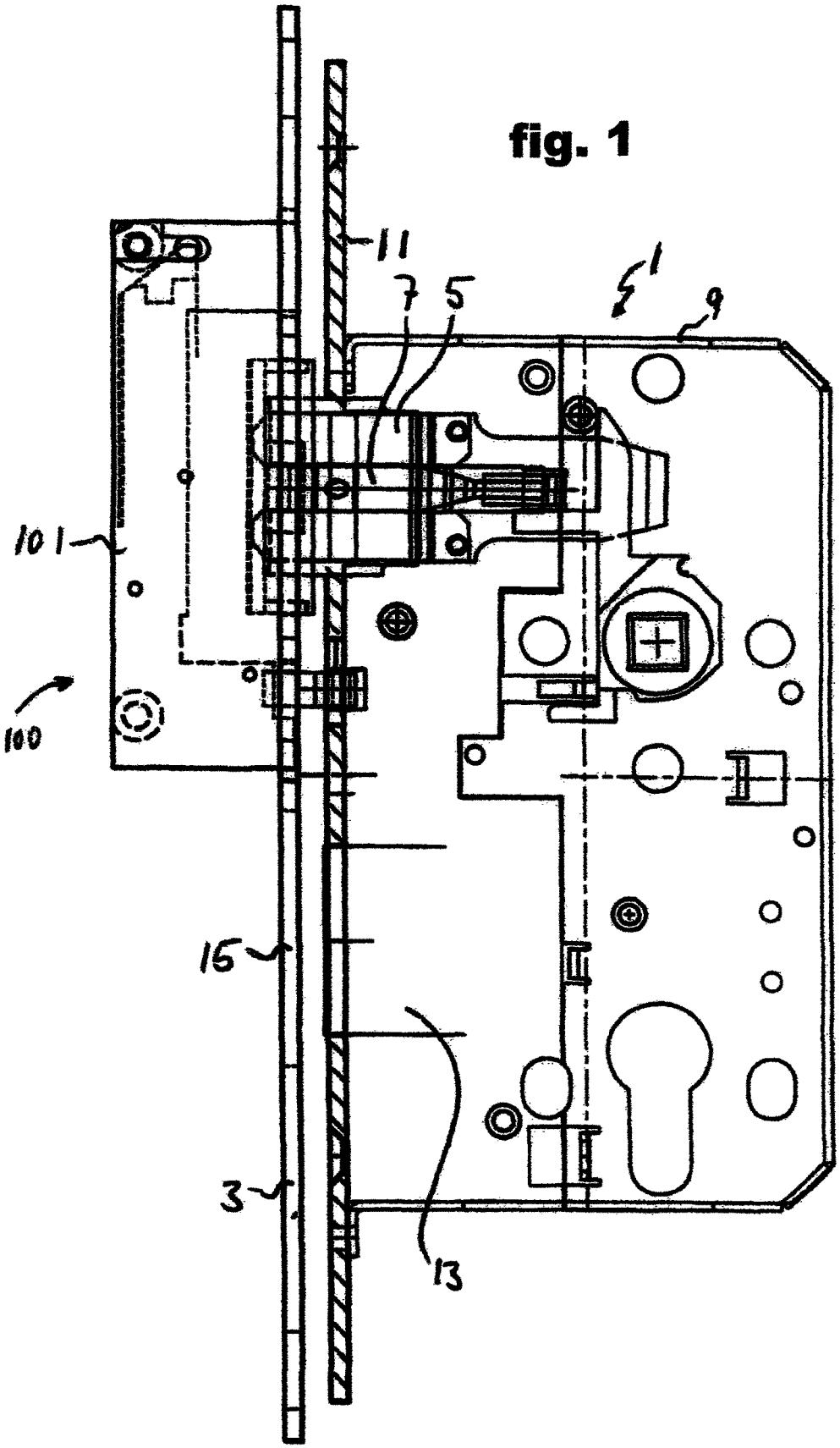
FIG. 1 shows a schematic side view of a door lock with an electromagnetic door opener attached to a strike plate in the closed position.

FIG. 1 is a schematic side view of a door lock 1 that cooperates with an electromagnetic door opener 100 attached to a strike plate 3. In the present embodiment the door lock 1 is a box lock adapted to being actuated by an electromagnetic door opener 100. Cooperation with the electromagnetic door opener 100 involves a door opener strike bolt 5 and locking member 7 connected with the door opener strike bolt 5. The door lock 1 comprises a housing 9, with which the door lock is attached to a fore-end track 11. In addition the door lock 1 may further comprise a lock bolt 13, which can engage in a bolt opening 15 of the strike plate 3.

The electromagnetic door opener 100 is attached to the strike plate 3 such that, when in a closed position, it can receive the door opener strike bolt 5 and hold it in the closed position, and when it is in an open position, releases the door opener strike bolt 5 so that it can move back, pre-tensioned, into the housing 9 of the door lock 1.

The electromagnetic door opener 100 comprises a door opener housing 101, which in the sectional view depicted in FIG. 1 is shaped into an approximate U-shape.

In FIG. 2 the electromagnetic door opener 100 is schematically shown in greater detail. The U-shaped door opener housing 101 has a lifting magnet 103 arranged in it, with which a plunger core pin 105 is connected in a back and forth moving manner. The lifting magnet 103 is supported against the housing floor 107 of the door opener housing 101. In FIG. 2 a situation is shown, in which the door opener strike bolt 5 and the locking member 7 are in a closed position.

In the closed position the plunger core pin 105 is in a retracted position. Several levers, i.e. lever 111, lever 113, lever 115 and lever 117 are arranged between the plunger core pin 105 and a hinged flap 109, in conjunction with a stop 110.

The kinematic chain is shown in detail in FIG. 3. The plunger core pin 105 with its free end 119 abuts against a straight side 121 of the lever 115. Lever 115 comprises a pivot axis 123. The lever 117 comprises a pivot axis 125 and a stop pin 127, which is aligned parallel to the pivot axis 125. The stop pin 127 runs on a circular-arc-shaped outer edge 129 of the lever 115 so that a movement of the lever 115 about the pivot axis 125 is in counterclockwise direction. This results in an unlocking position.

The lever 117, in the view shown in FIG. 2 and FIG. 3, is configured into approximately an L-shape. A long arm extends between the pivot axis 125 and the stop pin 127 and a shorter arm extends approximately perpendicularly to the longer arm between the pivot axis 125 and a free end configured as a blocking element 131. The blocking element 131 blocks the lever 113 in the closed position. The lever 113 comprises a pivot axis 133. The pivot axis 133, the pivot axis 125, and the pivot axis 123 extend parallel to each other and perpendicularly to the planes shown in FIG. 2 or FIG. 3.

Pivoting the lever 117 results in the blocking element 131 releasing the lever 113 to allow counterclockwise rotation about the pivot axis 133.

When applying a force to open the door, the lever 111, as the block is released, is rotated downwards in a clockwise direction (see FIG. 2), causing the lever 113 to deflect and twist in counterclockwise direction.

As a force is applied to open the door, the hinged flap 109, in conjunction with the stop 110, rotates in a counterclockwise direction about the pivot axis 137.

The aforementioned kinematic chain is a means for providing the electromagnetic door opener 100 with a safety device, which provides resistance twisting the door opener strike bolt with force from the closed position into the open position and represents both a primary safety stage and a secondary safety stage. The primary safety stage comprises the lever 111, the lever 113, and the housing floor 107. In the primary safety stage the lever 111 is supported in a formlock against the housing floor 107 via the lever 113. Contact between the lever 111 and the lever 113 is via a first lever gliding surface 139 on the lever 111 and a second lever gliding surface 141 on the lever 113, preferably at an angle of 25° to the housing floor 107. Due to a movement of the lever 113, a gliding contact is obtained at the first lever gliding surface 139 and at the second lever gliding surface 141, which leads to movement of the lever 111. Supporting the lever 111 via the two gliding surfaces 139 and 141 and the lever 113 against the housing floor 107 creates a stable lock of the electromagnetic door opener 100 in the closed position.

Should an external force be applied that is sufficient to overcome the primary safety stage, the depicted arrangement according to the invention provides a secondary safety stage. This secondary safety stage involves the lever 115, which is also supported in a formlock against the housing floor 107. Due to the lever 115 being directly supported against the housing floor 107, following the primary safety stage a second safety stage is created, which provides high resistance. The primary safety stage and the secondary safety stage in the depicted embodiment of the invention show a stability against twisting the hinged flap 109 and releasing the door opener strike bolt, which is in the region of approx. 10,000 N.

The pivot axis 135 of lever 111 extends perpendicularly to the pivot axes 123, 125 and 133 as well as parallel to the pivot axis 137 of the hinged flap 109. The hinged flap 109 is best understood with reference to FIG. 4. A recess 145 is formed in a flap part 143 on the inside, which extends beyond the strike plate 3. The recess 145 comprises an undercut 147 on the side of the lock. In the closed position shown in FIG. 4 the door opener strike bolt 5 is shown as having advanced into the electrical door opener and engaging the recess 145 with the locking member 7. To this end the locking member 7 comprises a locking tab 7.1, which comprises a stop surface 7.2 extending parallel to the undercut 147.

FIG. 5 shows the electromagnetic door opener 100 depicted in FIG. 2 in an open position. The components shown in FIG. 5 of the electromagnetic door opener 100 are identical to those in FIG. 2, though the components are depicted in FIG. 5 in changed relative positions to the extent where the door opener strike bolt 5/the locking member 7 is released from the engagement in the hinged flap 109 in conjunction with the stop 110, and, due to being pretensioned in opening direction, is pulled out of the strike plate and into the door lock 1.

The changed alignment of the above mentioned components in relation to each other is triggered by the plunger core pin 105. The resulting rotary movement of the components within a kinematic chain is described above. FIG. 6 shows in detail, how the stop pin 127, due to the rotary movement of the lever 115, has migrated along the circular-arc-shaped outer edge 129 thereof. Due to the pivotal movement of the lever 117 about the pivot axis 125 the second lever 113 is depicted out of a locking engagement with the blocking element 131. The blocking element 131 comprises an indentation 131.1, into which a free end 113.1 of the second lever 113 engages in a formlock in the closed position. In the opening position the lever 113 swiveled counterclockwise about the pivot axis 133 is actuated by the lever 111, which is depicted turned in a clockwise direction (see FIG. 7). FIG. 7 shows, how the hinged flap 109, compared to FIG. 4, has twisted counterclockwise about the pivot axis 137 of the flap. The locking tab 7.1 is shown having released itself out of the recess 145 so that the door opener strike bolt 5, together with the locking member 7, could retract in the direction of the door lock 1.

The described and shown movements of the above-mentioned components, which trigger one another, are only possible due to the individual components being elastically pre-tensioned. Numerous springs are mounted in the electromagnetic door opener 100 and in the door lock 1. Pre-tensioning is in all cases in the direction of the open position. Actuation of the lever 115 by the plunger core pin 105 therefore permits a sequence of movements, leading to a complete opening of the door lock 1.

The construction of this depicted embodiment according to the invention allows the first safety stage to fail without significant adverse effect on the second safety stage such that twisting of the flap 109 and stop 110 is not possible even in the event of such first stage failure. The lever 115 can only be actuated via the plunger core pin 105 which creates the added measure of safety.

Those skilled in the art will realize that this invention is capable of embodiments different from those shown and described. It will be appreciated that the detail of the structure of the disclosed apparatuses and methodologies can be changed in various ways without departing from the invention itself. Accordingly, the drawings and detailed description of the preferred embodiments are to be regarded as including such equivalents as do not depart from the spirit and scope of the invention.

The invention claimed is:

1. A door securing system comprising:

a door opener housing for fitting into a door frame, said door opener housing including a housing floor;

a hinged flap rotatable associated with said door opener housing between an open position and a closed position;

a first lever pivotably associated with said door opener housing, said first lever including a first lever gliding surface;

a second lever pivotably associated with said door opener housing, said second lever including a second lever gliding surface configured for contacting with said first lever gliding surface of said first lever;

a third lever pivotably associated with said door opener housing, said third lever including an outer edge; and a fourth lever pivotably associated with said door opener housing, said fourth lever having a first arm including a stop pin configured to travel on said outer edge of said third lever, and a second arm including a blocking element configured to block said second lever in the closed position;

wherein said first, second, third and fourth levers are configured to forcibly resist twisting of said flap from said closed position into said open position;

wherein said first lever is supported in a formlock against said housing floor by way of said second lever.

2. The door securing system of claim 1, wherein said second lever, said third lever and said fourth lever each includes a pivot axis that are parallel with each other.

3. The door securing system of claim 2, wherein said first lever includes a first lever pivot axis that is perpendicular to said pivot axis of said second, third and fourth levers.

4. The door securing system of claim 1, wherein pivoting of said fourth lever results in said blocking element releasing said second lever by rotation of said second lever.

5. The door securing system of claim 1, wherein the formlock between said first lever and said housing floor is created by an oblique surface of each of said first lever and said second lever in contact with each other when in the closed position.

6. The door securing system of claim 1, wherein said hinged flap is configured to prevent a locking member from retracting in a direction toward a door when in the closed position.

7. The door securing system of claim 6, wherein said hinged flap includes a recess defining an undercut on a side of said flap, said undercut is configured to engage with a stop surface of a locking tab of a locking member associate with a door in the closed position which prevents said locking member from retracting out of said recess.

8. The door securing system of claim 1, wherein said blocking element of said fourth lever includes an indentation configured to engage in a formlock with a free end of said second lever when in the closed position.

9. The door securing system of claim 1, wherein said outer edge of said third lever is a circular-arc-shaped outer edge.

10. The door securing system of claim 1, wherein said first arm and said second arm are substantially perpendicular to each other, with said first arm having a length greater than said second arm.

11. The door securing system of claim 1, wherein said first and second lever gliding surfaces, when in contact with each other, are at an angle of 25° to said housing floor.

12. The door securing system of claim 1, wherein a gliding contact is capable between said first and second lever gliding surfaces which leads to movement of said first lever.

13. The door securing system of claim 12, wherein said first lever being supported by way of said first and second lever gliding surfaces, and said second lever being supported by said housing floor creates a lock of said hinged flap in the closed position.

14. The door securing system of claim 1 further comprises a lifting magnet and a plunger core pin operably associated therewith, said plunger core pin, during an opening operation from a retracted position into an extended position, acts upon and causes said third lever to rotate, and wherein at said retracted position said fourth lever rests with said stop pin against said third lever.

15. The door securing system of claim 14, wherein movement of said plunger core pin from said retracted position to said extended position rotates said third lever that permits a sequence of movements of said first, second and fourth levers, allowing said hinged flap to rotate to the open position and releasing a door locking member engaged with said hinged flap.

16. A door securing system comprising:

a door opener housing for fitting into a door frame, said door opening housing including a housing floor;

a hinged flap rotatable associated with said door opener housing between an open position and a closed position;

a first lever pivotably associated with said door opener housing, said first lever including a first lever gliding surface;

a second lever pivotably associated with said door opener housing, said second lever including a second lever gliding surface configured for contacting with said first lever gliding surface of said first lever;

a third lever pivotably associated with said door opener housing, said third lever including an outer edge;

a fourth lever pivotably associated with said door opener housing, said fourth lever having a first arm including a stop pin configured to travel on said outer edge of said third lever, and a second arm including a blocking element configured to block said second lever in the closed position; and a lifting magnet and a plunger core pin operably associated therewith, said plunger core pin, during an opening operation from a retracted position into an extended position, acts upon and causes said third lever to rotate, and wherein at said retracted position said fourth lever rests with said stop pin against said third lever;

wherein said first, second, third and fourth levers are configured to forcibly resist twisting of said flap from said closed position into said open position;

wherein said first lever is supported in a formlock against said housing floor by way of said second lever.

17. The door securing system of claim 16, wherein said hinged flap is configured to prevent a locking member from retracting in a direction toward a door when in the closed position.

18. The door securing system of claim 17, wherein said hinged flap includes a recess defining an undercut on a side of said flap, said undercut is configured to engage with a stop surface of a locking tab of a locking member associate with a door in the closed position which prevents said locking member from retracting out of said recess.

19. The door securing system of claim 18, wherein movement of said plunger core pin from said retracted position to said extended position rotates said third lever that permits a sequence of movements of said first, second and fourth levers, allowing said hinged flap to rotate to the open position and releasing said stop surface of said locking tab of said locking member engaged from said undercut of said hinged flap.

* * * * *